US011456525B2

(12) United States Patent
Katsura et al.

(10) Patent No.: US 11,456,525 B2
(45) Date of Patent: Sep. 27, 2022

(54) ANTENNA MODULE AND VEHICLE

(71) Applicant: SUMITOMO ELECTRIC INDUSTRIES, LTD., Osaka (JP)

(72) Inventors: Isao Katsura, Osaka (JP); Tatsuhiro Shimura, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 145 days.

(21) Appl. No.: 16/964,650

(22) PCT Filed: Oct. 18, 2018

(86) PCT No.: PCT/JP2018/038820
§ 371 (c)(1),
(2) Date: Jul. 24, 2020

(87) PCT Pub. No.: WO2019/150666
PCT Pub. Date: Aug. 8, 2019

(65) Prior Publication Data

US 2021/0057806 A1 Feb. 25, 2021

(30) Foreign Application Priority Data

Feb. 5, 2018 (JP) ..... JP2018-018330

(51) Int. Cl.

| | |
|---|---|
| ***H01Q 1/32*** | (2006.01) |
| ***H01Q 1/42*** | (2006.01) |
| ***H01Q 3/26*** | (2006.01) |
| *H01Q 3/02* | (2006.01) |
| *H01Q 19/10* | (2006.01) |
| *H01Q 9/04* | (2006.01) |
| *H01Q 1/12* | (2006.01) |

(52) U.S. Cl.
CPC ..... *H01Q 1/3275* (2013.01); *H01Q 1/42* (2013.01); *H01Q 3/26* (2013.01); *H01Q 1/125* (2013.01); *H01Q 3/02* (2013.01); *H01Q 9/04* (2013.01); *H01Q 19/10* (2013.01)

(58) Field of Classification Search
CPC ..... H01Q 1/3275; H01Q 1/42; H01Q 3/26; H01Q 1/125; H01Q 9/04; H01Q 3/02; H01Q 19/10
See application file for complete search history.

(56) References Cited

U.S. PATENT DOCUMENTS

| | | | | |
|---|---|---|---|---|
| 6,580,401 | B1 | 6/2003 | Gerhard | |
| 9,778,368 | B2 * | 10/2017 | Krantz | G01S 19/36 |
| 2009/0058733 | A1 | 3/2009 | Kurashima et al. | |
| 2017/0069950 | A1 * | 3/2017 | Kim | H01Q 9/0414 |

FOREIGN PATENT DOCUMENTS

| | | | |
|---|---|---|---|
| CN | 1862877 | A | 11/2006 |
| CN | 103280626 | A | 9/2013 |
| JP | H01-143503 | U | 10/1989 |
| JP | H10-327010 | A | 12/1998 |
| JP | 2003-017916 | A | 1/2003 |
| JP | 2013-106146 | A | 5/2013 |
| WO | WO-2017/170906 | A1 | 10/2017 |

* cited by examiner

*Primary Examiner* — Joseph J Lauture
(74) *Attorney, Agent, or Firm* — Faegre Drinker Biddle & Reath LLP

(57) ABSTRACT

An antenna module 4 includes one antenna base 25 having a radiation surface 25*a* inclined relative to an opening plane 23 at which a radome 22 is attached, and another antenna base 25 having a radiation surface 25*a* inclined in a direction different from the one antenna base 25.

8 Claims, 7 Drawing Sheets

ANTENNA MODULE AND VEHICLE

TECHNICAL FIELD

The present invention relates to an antenna module and a vehicle.

This application claims priority on Japanese Patent Application No. 2018-018330 filed on Feb. 5, 2018, the entire content of which is incorporated herein by reference.

BACKGROUND ART

As a conventional example of antennas attached to vehicles, there is an antenna attached to a vehicle body top surface such as a roof (see PATENT LITERATURE 1).

Citation List

Patent Literature

PATENT LITERATURE 1: Japanese Laid-Open Patent Publication No. 2013-106146

SUMMARY OF INVENTION

An antenna module according to one embodiment includes: a first antenna having a first radiation surface inclined relative to a placement plane at which a radome is provided; and a second antenna having a second radiation surface inclined in a direction different from the first antenna.

A vehicle according to another embodiment is a vehicle including the above antenna module.

DESCRIPTION OF EMBODIMENTS

Figure 1:
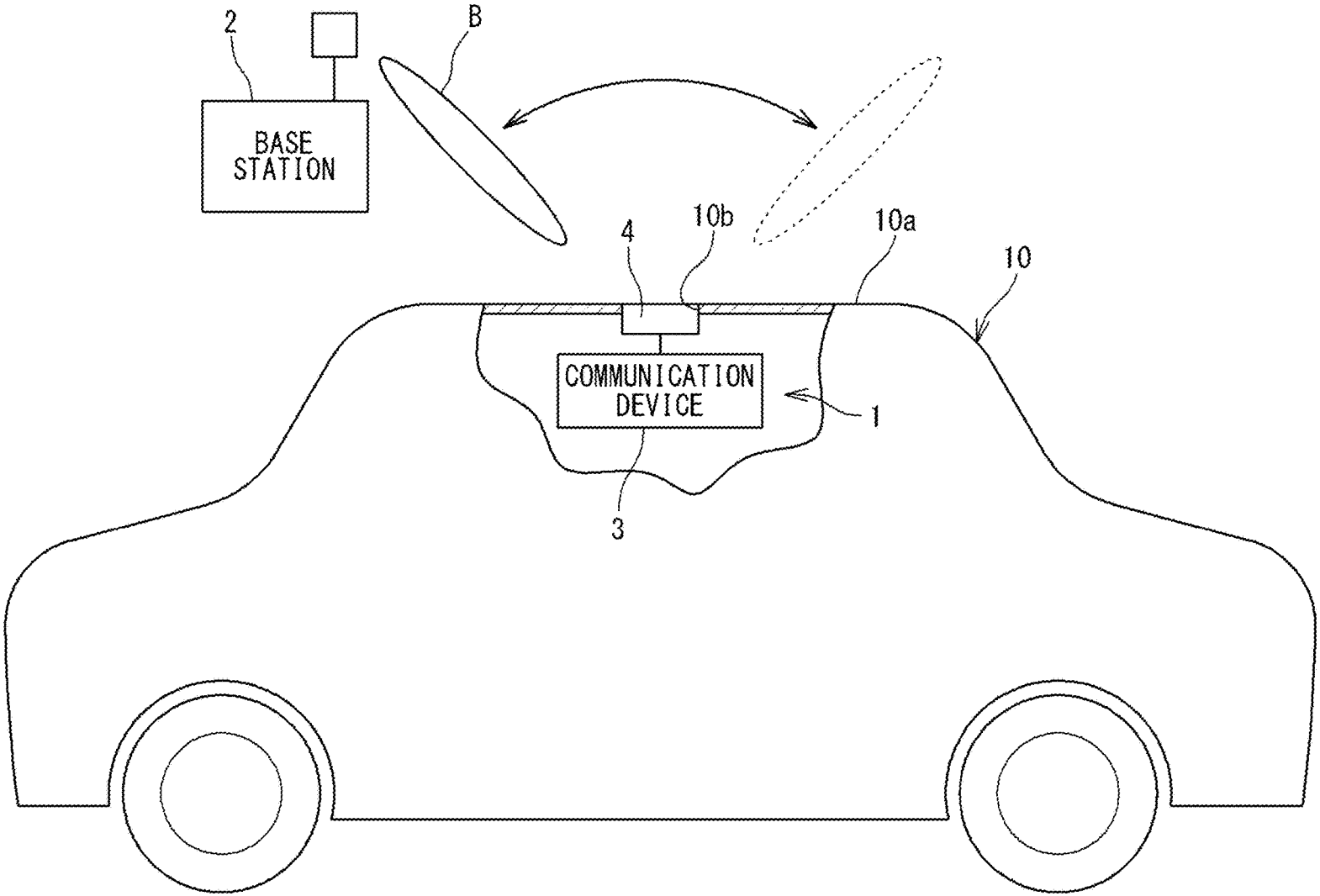
FIG. 1 is a view showing a vehicle to which an on-vehicle communication apparatus is mounted.

Problems to be Solved by the Present Disclosure

Since the above antenna is attached to the vehicle body top surface, the height of the antenna is required to be reduced as much as possible in view of the vehicle height limit, design, and the like for the vehicle.

Here, it is conceivable that the antenna is embedded in the vehicle body so that the antenna does not protrude from the vehicle top surface.

However, for example, in a case where a planar antenna is mounted so as to be embedded in the vehicle body, a radiation surface of the antenna is arranged so as to face in the vertical direction, and thus the orientation direction is restricted.

The present disclosure has been made in view of the above circumstances, and an object of the present disclosure is to provide an antenna module and a vehicle that can ensure the orientation direction over a wide range.

Effects of the Present Disclosure

According to the present disclosure, the orientation direction can be ensured over a wide range.

First, contents of embodiments are listed and described.

Summary of Embodiments (1) An antenna module according to one embodiment includes: a first antenna having a first radiation surface inclined relative to a placement plane at which a radome is provided; and a second antenna having a second radiation surface inclined in a direction different from the first antenna.

In the antenna module configured as described above, since the first antenna and the second antenna having the radiation surfaces inclined relative to the placement plane are provided, it is possible to appropriately transmit/receive also radio waves of which the orientation direction crosses the normal direction of the placement plane. Thus, the orientation direction of radio waves transmitted/received through the radome attached at the placement plane can be ensured over a wide range.

(2) In the above antenna module, preferably, the first antenna and the second antenna are arranged such that a normal direction of the first radiation surface and a normal direction of the second radiation surface cross each other on a side where both radiation surfaces are present.

In this case, the radiation surfaces of both antennas can face toward the center side of the placement plane, and the area of the placement plane through which transmitted/received radio waves pass can be reduced as compared to a case where radio waves from both antennas are radiated in different directions so as not to cross each other.

(3) In the above antenna module, a band-like bending portion which is bendable may be provided on a base end side of each of the first antenna and the second antenna.

In this case, the radiation surfaces of the first antenna and the second antenna can be easily inclined.

(4) Preferably, the above antenna module further includes a circuit substrate to which an RF circuit is provided, and the first antenna and the second antenna are each connected to the circuit substrate via the bending portion.

In this case, the first antenna and the second antenna can be inclined using the circuit substrate as a base end.

(5) Preferably, the above antenna module further includes a box-shaped housing of which one face forms the placement plane, the housing storing the first antenna and the second antenna therein, and the housing has therein retaining portions which retain the first antenna and the second antenna in a state in which the first antenna and the second antenna are inclined.

In this case, the first antenna and the second antenna can be retained in an inclined state.

(6) Preferably, the housing has an opening at the one face, and a fixation portion that comes into contact with a peripheral edge of the radome and fixes the radome is provided at an end edge of the opening.

In this case, the antennas, the housing, and the radome can be integrated.

(7) In the above antenna module, the first antenna and the second antenna may be each an array antenna capable of forming a beam, and the antenna module may further include a control unit configured to control a direction of the beam within such a range that the beam is not blocked by a conductor located around the radome.

In this case, it is possible to appropriately form a beam in such a range that the beam is not obstructed.

(8) Preferably, the antenna module is for use in a vehicle.

In this case, the vehicle can be used as a mobile station, with the antenna module attached to the vehicle.

(9) A vehicle according to another embodiment is a vehicle including the antenna module according to any one of the above (1) to (8).

This configuration enables a vehicle to be used as a mobile station.

(10) In the above vehicle, preferably, the antenna module is attached to an opening provided in a body of the vehicle such that a surface of the radome is flush with a surface of the body.

In this case, while the antenna modules are provided so as not to protrude from the body of the vehicle, the orientation direction of radio waves transmitted/received through the placement plane can be ensured over a wide range.

(11) Preferably, in the above antenna module, the first antenna and the second antenna are inclined such that the first radiation surface and the second radiation surface face toward a center side of the placement plane.

DETAILS OF EMBODIMENTS

Hereinafter, preferred embodiments will be described with reference to the drawings.

At least some parts of the embodiments described below may be combined together as desired.

FIG. 1 is a view showing a vehicle to which an on-vehicle communication apparatus is mounted.

In FIG. 1, an on-vehicle communication apparatus 1 is mounted to a vehicle 10. The on-vehicle communication apparatus 1 is a mobile station which performs wireless communication with a base station 2 of a mobile communication system. As the vehicle 10, a normal passenger car, a bus, a railroad vehicle, etc., are included.

The base station 2 is provided at a comparatively high location such as a rooftop of a building, and performs wireless communication with the on-vehicle communication apparatus 1 on the ground.

The wireless communication performed between the on-vehicle communication apparatus 1 and the base station 2 is wireless communication compliant with a 5th-generation mobile communication system, for example.

In the 5th-generation mobile communication system, for example, radio waves having a very high frequency of 6 GHz or higher are used, and therefore attenuation during propagation is great. Accordingly, the on-vehicle communication apparatus 1 and the base station 2 perform beamforming to compensate for attenuation of the radio waves. The on-vehicle communication apparatus 1 can perform control so that the direction of a beam B is directed toward the base station 2.

The on-vehicle communication apparatus 1 mounted to the vehicle 10 includes a communication device 3 and an antenna module 4. The communication device 3 performs wireless communication with the base station 2 by using the antenna module 4. In addition, the communication device 3 performs wireless LAN communication with a mobile terminal (not shown) such as a smartphone present in the vehicle 10 via a wireless LAN or the like. The communication device 3 has a function of relaying communication between such a mobile terminal in the vehicle 10 and the base station 2.

The communication device 3 gives a transmission baseband signal to the antenna module 4. In addition, the communication device 3 receives a reception baseband signal given from the antenna module 4.

The antenna module 4 is connected to the communication device 3, and the antenna module 4 modulates the transmission baseband signal given from the communication device 3, into an RF signal, performs signal processing such as phase control and amplification thereon, and wirelessly transmits an RF signal obtained by the signal processing. In addition, the antenna module 4 receives radio waves transmitted from the base station 2, to obtain an RF signal. Then, the antenna module 4 performs signal processing such as modulation, amplification, and phase control on the RF signal, and gives a reception baseband signal obtained by the signal processing, to the communication device 3. That is, the antenna module 4 forms a front-end module in the on-vehicle communication apparatus 1.

The antenna module 4 is attached to, for example, an opening 10*b* provided in a roof 10*a* of the vehicle 10, for transmission and reception of RF signals. The antenna module 4 is attached in an embedded state so as to be almost flush with the surface of the roof 10*a*.

Figure 2:
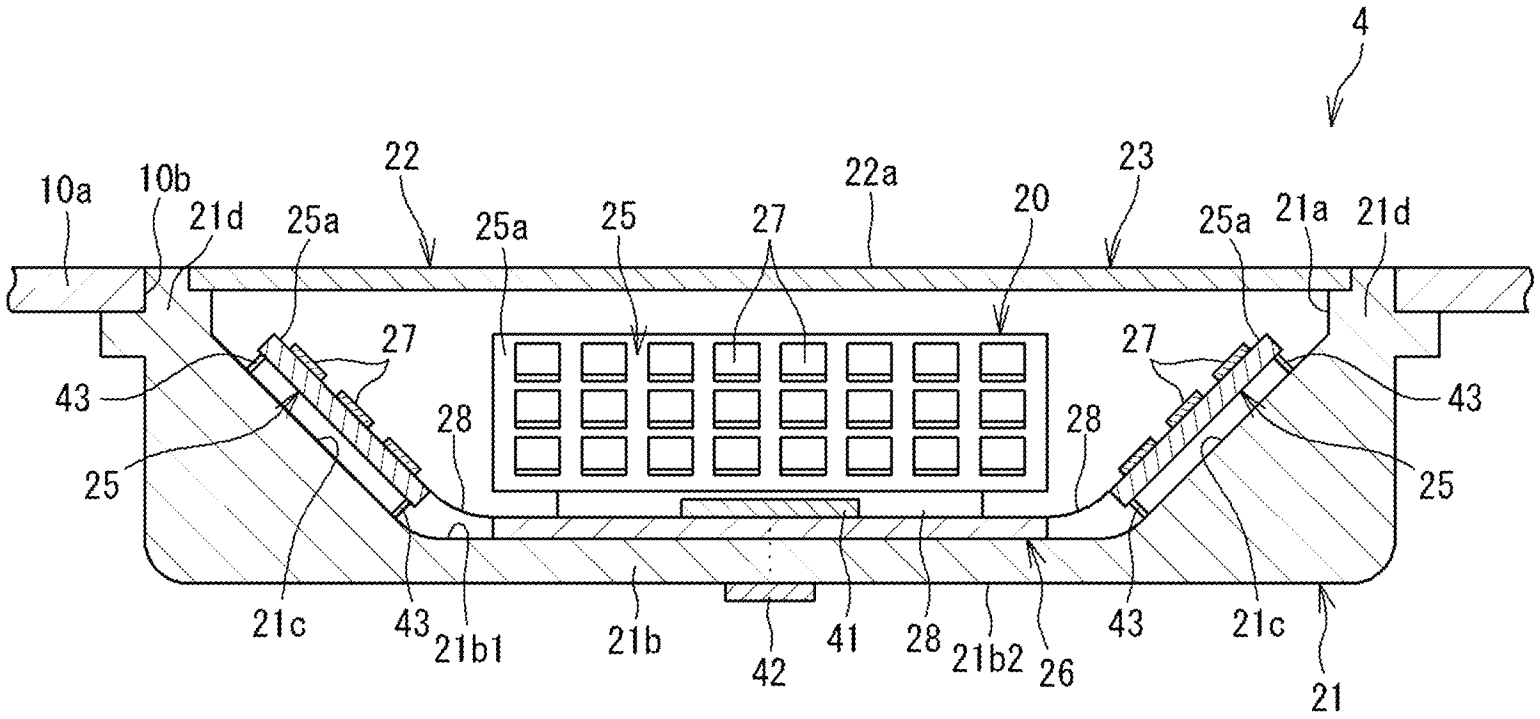
FIG. 2 is a sectional view of an antenna module.

FIG. 2 is a sectional view of the antenna module 4.

In FIG. 2, the antenna module 4 includes a module body 20, a housing 21 storing the module body 20, and a radome 22.

The housing 21 is a member made of resin or the like, and is formed in a box shape of which one face has a rectangular opening 21*a*. The housing 21 is attached to the opening 10*b* of the roof 10*a* such that the opening 21*a* opens outward of the vehicle.

The size of the housing 21 is set such that, for example, the plane dimension is approximately 100 mm to 200 mm, and the height dimension is approximately several tens of mm.

The radome 22 is a rectangular plate-shaped member made of resin or the like, and closes the opening 21*a* of the housing 21.

The radome 22 protects the module body 20 from outside while allowing radio waves transmitted/received by the module body 20 to pass therethrough.

The radome 22 is placed at an opening plane 23 (placement plane) defined by the opening 21*a*.

The peripheral edge of the radome 22 is fixed to an end edge 21*d* of the housing 21. The end edge 21*d* retains the radome 22 such that the radome 22 is attached and fixed at the opening plane 23.

A surface 22*a* of the radome 22 is formed to be almost flush with the surface of the roof 10*a*.

Here, being flush refers to substantially being flush, and includes, for example, a case where the radome 22 has a curved surface slightly protruding relative to a curved surface along the surface shape of the roof 10*a*, and a case where the radome 22 slightly protrudes or dents from the surface of the roof 10*a* depending on the attachment method, the manufacturing method for each part, or the like.

Figure 3:
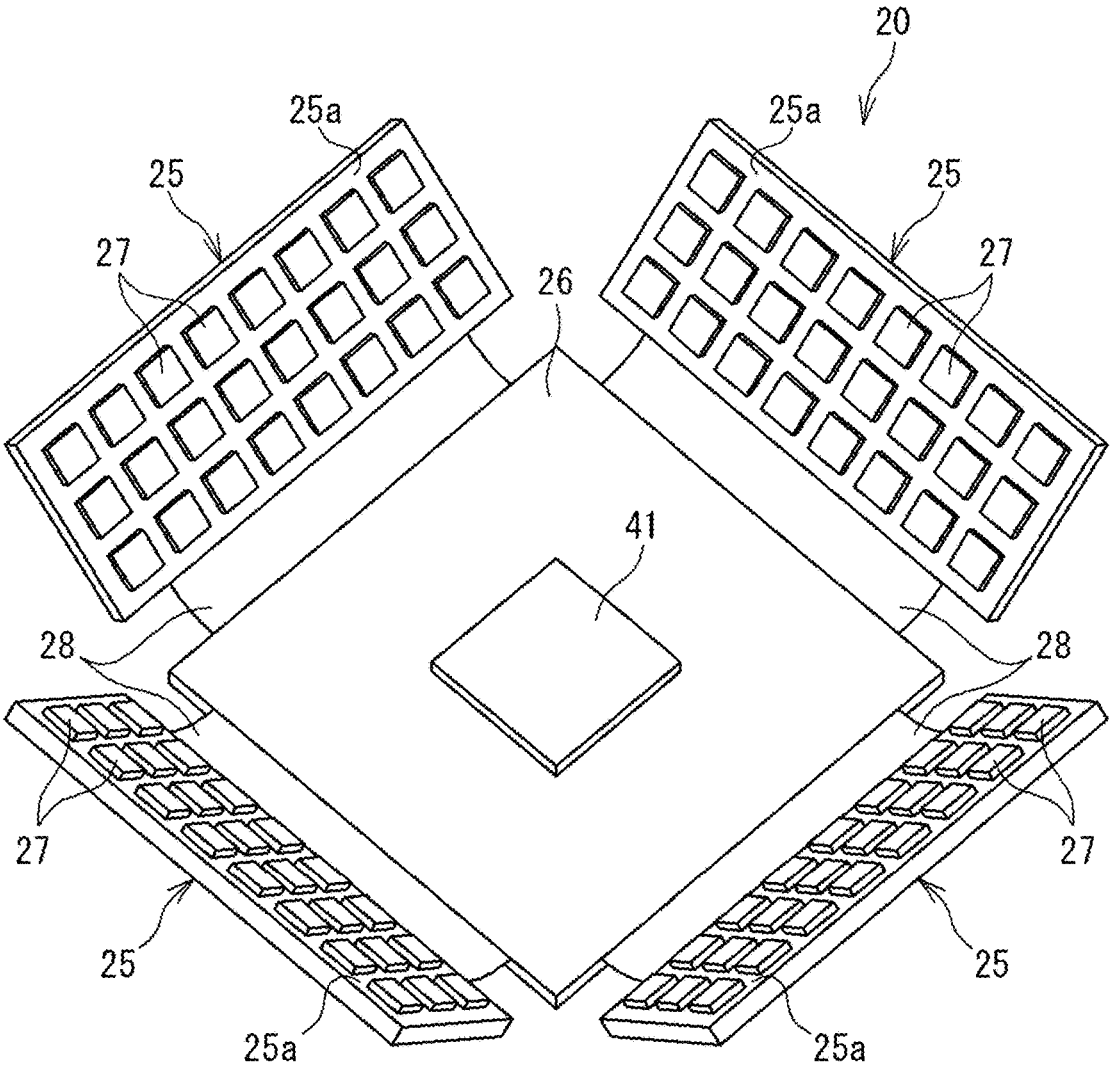
FIG. 3 is a perspective view showing a module body.

FIG. 3 is a perspective view showing the module body 20.

As shown in FIG. 2 and FIG. 3, the module body 20 includes four antenna bases 25 (first antenna, second antenna) and a circuit substrate 26.

Each antenna base 25 is formed in a rectangular plate shape by layering insulating materials such as glass fabric base epoxy resin material, for example. On a radiation surface 25*a* (first radiation surface, second radiation surface) of the antenna base 25, a plurality of radiation elements 27 are provided. Each radiation element 27 is, for example, a planar antenna.

The antenna bases 25 each form an array antenna by the plurality of radiation elements 27, and are each capable of beamforming individually.

The four antenna bases 25 are connected to the circuit substrate 26 via band-like bending portions 28.

Each bending portion 28 is formed by a flexible dielectric film deformable to be bent (flexed), for example.

Figure 4:
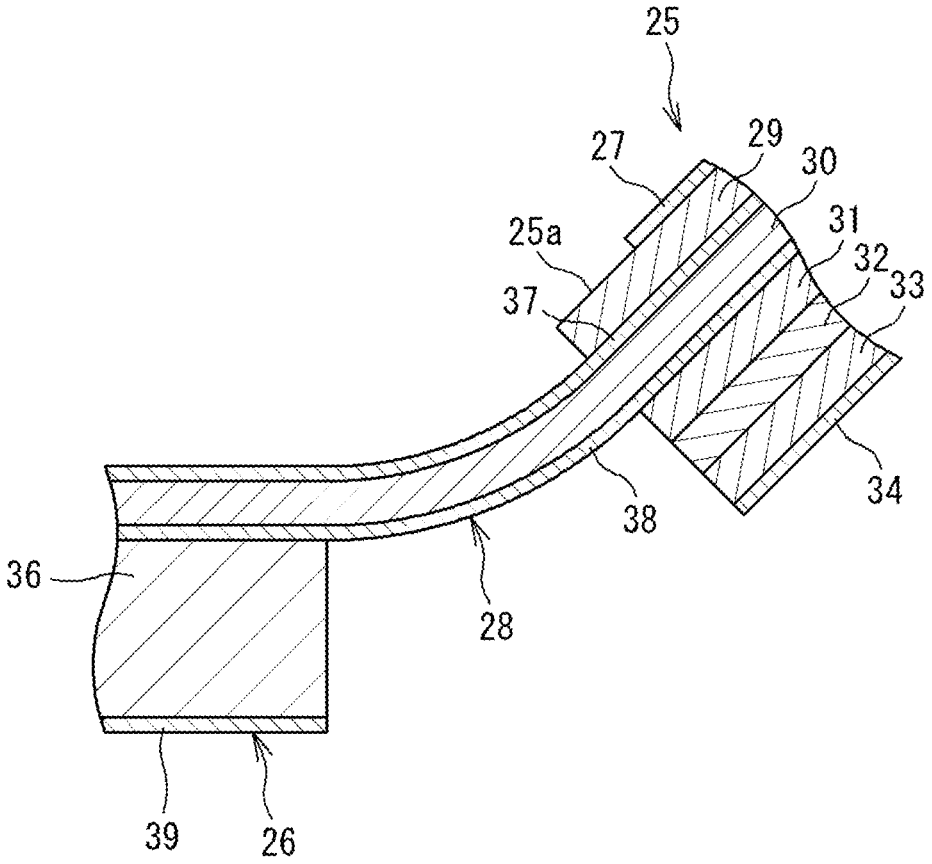
FIG. 4 is a sectional view of a bending portion.

FIG. 4 is a sectional view of the bending portion 28.

As shown in FIG. 4, the antenna base 25 includes a first dielectric layer 29, a second dielectric layer 30, a third dielectric layer 31, a fourth dielectric layer 32, and a fifth dielectric layer 33. The radiation elements 27 are mounted on, of the dielectric layers, the first dielectric layer 29 whose top surface forms the radiation surface 25*a*.

The second dielectric layer 30 protrudes from an end surface of the antenna base 25 to extend to the circuit substrate 26 side. The bending portion 28 is formed by the part of the second dielectric layer 30 that extends from the end surface of the antenna base 25 to the circuit substrate 26 side. That is, the bending portion 28 is formed integrally with the second dielectric layer 30.

Here, the first dielectric layer 29, the third dielectric layer 31, the fourth dielectric layer 32, and the fifth dielectric layer 33 are formed of an insulating material such as glass fabric base epoxy resin material, and meanwhile, the second dielectric layer 30 is formed of a dielectric film. Thus, the bending portion 28 is formed of the dielectric film.

The bending portion 28 is layered on a dielectric layer 36 of the circuit substrate 26 and forms a part of layers of the circuit substrate 26. Thus, the bending portion 28 is formed integrally with the circuit substrate 26.

Thus, the bending portion 28 is formed integrally with the antenna base 25 and the circuit substrate 26, and connects the antenna base 25 and the circuit substrate 26.

A power feed line 37 made of a conductor is formed between the first dielectric layer 29 and the second dielectric layer 30.

The power feed line 37 is a line for feeding power to the radiation element 27. In FIG. 4, the cross section of one power feed line 37 is shown, but in the bending portion 28, a plurality of power feed lines 37 are formed correspondingly for the radiation elements 27 provided on the antenna base 25.

The power feed line 37 is connected to the radiation element 27 via a through hole or the like (not shown). The power feed line 37 passes from the antenna base 25 through the bending portion 28 and is formed across the circuit substrate 26.

In addition, a ground pattern 38 made of a conductor is provided between the second dielectric layer 30 and the third dielectric layer 31. The ground pattern 38 also passes from the antenna base 25 through the bending portion 28 and is formed across the circuit substrate 26.

The ground pattern 38 is connected to a ground pattern 34 of the antenna base 25 via a through hole or the like (not shown). In addition, the ground pattern 38 is connected to a ground pattern 39 formed at the dielectric layer 36 of the circuit substrate 26, via a through hole or the like (not shown).

The ground pattern 38 is provided so as to be opposed to the power feed line 37, across the antenna base 25, the bending portion 28, and the circuit substrate 26. Thus, the power feed line 37 functions as a microstrip line. In FIG. 2 and FIG. 3, the power feed line 37 is not shown.

The bending portion 28 connects the antenna base 25 and the circuit substrate 26 so as to allow power feeding therebetween by the power feed line 37.

As shown in FIG. 2 and FIG. 3, the circuit substrate 26 is a rectangular plate shaped substrate, and is formed of an insulating material such as glass fabric base epoxy resin material. An RF circuit 41 for performing signal processing for transmission/reception of the RF signal described above is mounted to the circuit substrate 26. In the present embodiment, the circuit substrate 26 has an almost square plate shape. The circuit substrate 26 is fixed to an inner surface 21*b*1 of a bottom portion 21*b* of the housing 21.

The power feed line 37 extending from the antenna base 25 through the bending portion 28 to the circuit substrate 26 is connected to the RF circuit 41. That is, each radiation element 27 is connected to the RF circuit 41 via the power feed line 37.

The inner surface 21*b*1 is formed almost in parallel to the opening plane 23. Thus, the circuit substrate 26 is fixed almost in parallel to the opening plane 23.

In addition, the circuit substrate 26 is fixed almost in parallel to the horizontal plane. Therefore, also the opening plane 23 is almost parallel to the horizontal plane. Here, the horizontal plane refers to the horizontal plane when the vehicle 10 is in a horizontal state.

A connector 42 for connecting the RF circuit 41 and the communication device 3 is provided on an outer surface 21*b*2 of the bottom portion 21*b* of the housing 21.

The bending portion 28 is connected to each side end of the circuit substrate 26. Thus, the antenna base 25 is connected to each side end of the circuit substrate 26 via the bending portion 28.

The antenna base 25 is inclined relative to the circuit substrate 26 by the bending portion 28 being bent (flexed). It is noted that the circuit substrate 26 is fixed almost horizontally when the vehicle 10 is stopped on a horizontal road.

As described above, each antenna base 25 is connected to the circuit substrate 26 via the bending portion 28, and thus each antenna base 25 can be inclined using the circuit substrate 26 as a base end.

Each antenna base 25 is fixed to the housing 21 so as to be inclined relative to the opening plane 23 at which the radome 22 is attached.

The antenna base 25 is fixed via a bracket 43 to an inclined portion 21*c* rising from an edge of the inner surface 21*b*1. The antenna base 25 is fixed to the inclined portion 21*c* almost in parallel to the inclined portion 21*c*.

Thus, the radiation surface 25*a* of each antenna base 25 is inclined relative to the opening plane 23.

The antenna bases 25 are inclined by being raised in such directions that their radiation surfaces 25*a* face each other, using the respective side ends of the circuit substrate 26 as base ends. Thus, the antenna bases 25 are inclined in directions different from each other.

The state in which the antenna bases 25 are inclined in directions different from each other refers to a state in which the normal directions of the antenna bases 25 described later are different from each other.

Thus, since the bending portion 28 which is bendable is provided on the base end side of each antenna base 25, the radiation surfaces 25*a* of the antenna bases 25 can be easily inclined as compared to a case where, for example, the radiation elements 27 of the antenna base 25 are mounted to the circuit substrate 26 and thus the antenna base 25 and the circuit substrate 26 are integrally formed.

In addition, the antenna bases 25 are fixed in an inclined state such that the normal directions of the radiation surfaces 25*a* cross each other on the radiation surface 25*a* side. Thus, the radiation surface 25*a* of each antenna base 25 faces in one of the four directions, i.e., front, rear, right, and left, around the circuit substrate 26, in terms of horizontal plane direction, and faces obliquely upward relative to the horizontal direction, in terms of vertical plane direction.

Thus, in terms of horizontal plane direction, the antenna module 4 can adapt to orientation directions in a shared manner by the antenna bases 25, and in terms of vertical plane direction, the radiation surfaces 25*a* of the antenna bases 25 face obliquely upward, whereby the orientation direction can be directed toward the base station 2 provided at a high location.

It is noted that the normal direction of the radiation surface 25*a* refers to a direction orthogonal to the radiation surface 25*a*.

Figure 5A:
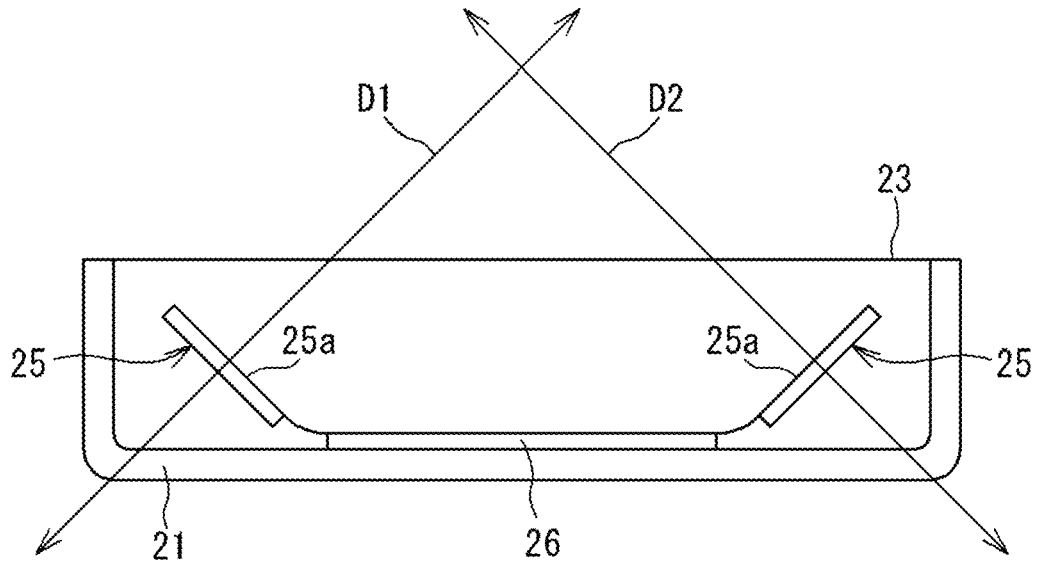
FIG. 5A is a view illustrating normal directions of radiation surfaces and shows arrangement of antenna bases in an embodiment.
Figure 5B:
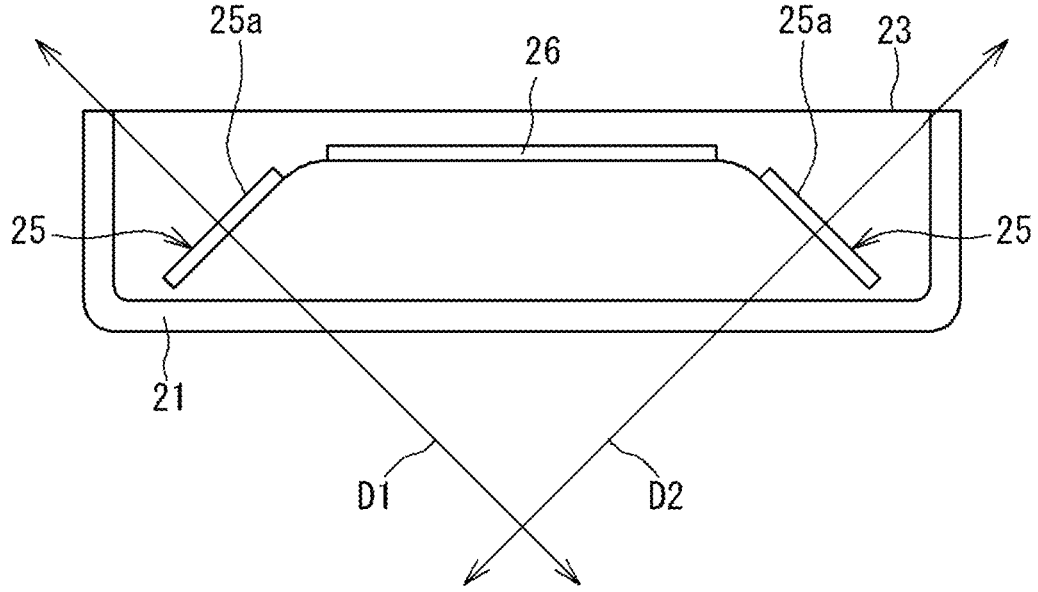
FIG. 5B is a view illustrating normal directions of radiation surfaces and shows another example of arrangement of antenna bases.

FIG. 5A and FIG. 5B are views illustrating the normal directions of the radiation surfaces. FIG. 5A shows arrangement of the antenna bases 25 in the present embodiment.

As shown in FIG. 5A, each antenna base 25 in the present embodiment is inclined such that the radiation surface 25*a* faces toward the center side of the opening plane 23.

Thus, a normal direction D1 of one antenna base 25 (left side in the drawing) and a normal direction D2 of another antenna base 25 (right side in the drawing) cross each other on the radiation surface 25*a* side.

That is, one antenna base 25 and another antenna base 25 are inclined such that their beams (orientation directions) cross each other.

FIG. 5B shows another example of arrangement of the antenna bases 25.

In FIG. 5B, each antenna base 25 is inclined such that the radiation surface 25*a* faces toward the side opposite to the center side of the opening plane 23.

Thus, a normal direction D1 of one antenna base 25 (left side in the drawing) and a normal direction D2 of another antenna base 25 (right side in the drawing) cross each other on the side opposite to the radiation surface 25*a* side.

That is, in FIG. 5B, one antenna base 25 and another antenna base 25 are inclined such that their beams (orientation directions) do not cross each other.

In FIG. 5A and FIG. 5B, cases where the antenna bases 25 are arranged so as to be opposed to each other with the circuit substrate 26 therebetween have been described. However, the same applies to a case where the antenna bases 25 are arranged so as to be adjacent to each other on the circuit substrate 26.

In the present embodiment, as shown in FIG. 5A, the antenna bases 25 are fixed in an inclined state such that the normal directions of their radiation surfaces 25*a* cross each other. Thus, the radiation surfaces 25*a* of the antenna bases 25 can face toward the center side of the opening plane 23, and the area of the opening plane 23 through which transmitted/received radio waves pass can be reduced as compared to a case where radio waves from the antenna bases 25 are radiated in different directions so as not to cross each other, for example.

In the present embodiment, since the plurality of antenna bases 25 having the radiation surfaces 25*a* inclined in directions different from each other relative to the opening plane 23 are provided, it is possible to appropriately transmit/receive also radio waves of which the orientation direction crosses the normal direction of the opening plane 23. Thus, the orientation direction of radio waves transmitted/received through the radome 22 attached at the opening plane 23 can be ensured over a wide range.

The antenna module 4 of the present embodiment includes the inclined portions 21*c* (retaining portions) for retaining the antenna bases 25 in a state in which their radiation surfaces 25*a* are inclined relative to the opening plane 23. Thus, the antenna bases 25 can be appropriately retained.

At the upper end of the inclined portion 21*c*, the aforementioned end edge 21*d* (fixation portion) to which the peripheral edge of the radome 22 is fixed is formed. Thus, since the end edge 21*d* is formed at the inclined portion 21*c*, the antenna bases 25, the housing 21 including the inclined portions 21*c*, and the radome 22 can be integrated.

The antenna module 4 of the present embodiment is for use in vehicles as described above. Therefore, the vehicle 10 provided with the antenna module 4 can be favorably used as a mobile station.

In the present embodiment, the antenna module 4 is attached to the opening 10*b* formed in the roof 10*a* which is the body of the vehicle 10, such that the radome 22 is flush with the surface of the roof 10*a*.

Thus, while the antenna module 4 is provided so as not to protrude from the body of the vehicle 10, the orientation direction of radio waves transmitted/received through the radome 22 attached to the opening plane 23 can be ensured over a wide range.

Figure 6:
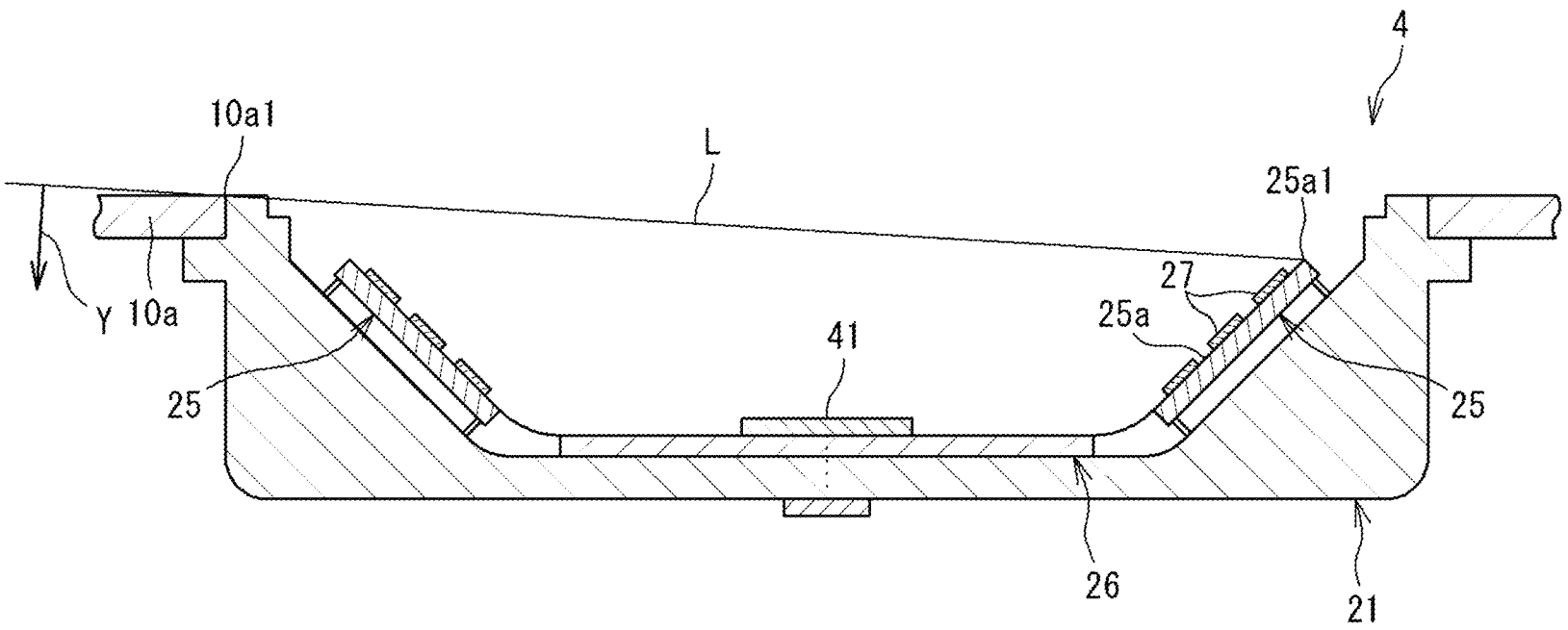
FIG. 6 is an end view of the antenna module in the embodiment.

FIG. 6 is an end view of the antenna module 4 in the present embodiment.

As described above, each antenna base 25 in the present embodiment is capable of beamforming. In addition, the RF circuit 41 has a function of controlling the beam direction on the basis of a command from the communication device 3.

Here, as shown in FIG. 6, the antenna module 4 is embedded in the surface of the roof 10*a*, and therefore, the vertical plane direction of a beam formed by the radiation surface 25*a* of each antenna base 25 needs to be directed upward relative to the horizontal direction so as to avoid the antenna base 25 opposed to the radiation surface 25*a*.

In the present embodiment, since radio waves having a very high frequency of 6 GHz or higher are used, the radio waves are blocked by a conductor such as metal. Therefore, a range (arrow Y side) below a line L passing an uppermost end 25*a*1 of the antenna base 25 and an end edge 10*a*1 of the roof 10*a* formed of a steel plate is a non-line-of-sight area where it is impossible to form a beam toward outside as seen from the antenna base 25.

Accordingly, the RF circuit 41 in the present embodiment is configured to control a beam in such a range that the beam is not obstructed (blocked) by the roof 10*a* which is a conductor around the antenna module 4.

More specifically, irrespective of a command from the communication device 3, the RF circuit 41 controls the beam direction in such a range that an effective beam can be obtained, without directing beams in such directions that most beams are directed into the non-line-of-sight area.

Thus, it is possible to appropriately form a beam in such a range that the beam is not obstructed (blocked).

Preferably, the angle of each antenna base 25 relative to the horizontal plane is set in a range of 45 degrees to 60 degrees, and for example, is set to 50 degrees or 55 degrees.

If the angle of the antenna base 25 relative to the horizontal plane is set to be greater than 60 degrees, the height dimension of the antenna module 4 increases, and in addition, the position of the antenna base 25 is further lowered from the roof 10*a*, so that the range in which the beam is obstructed by the roof 10*a* is increased. On the other hand, if the angle of the antenna base 25 relative to the horizontal plane is smaller than 45 degrees, the angle between the orientation direction in which the antenna base 25 can be directed and the horizontal plane is increased, so that the orientation direction of the antenna base 25 is restricted within a range close to the upward direction of the vehicle 10.

Therefore, the angle of each antenna base 25 relative to the horizontal plane is preferably set in a range of 45 degrees to 60 degrees.

In the present embodiment, a case where each antenna base 25 is connected to the circuit substrate 26 via the bending portion 28 has been shown as an example. However, each antenna base 25 need not be connected to the circuit substrate 26 via the bending portion 28.

Figure 7:
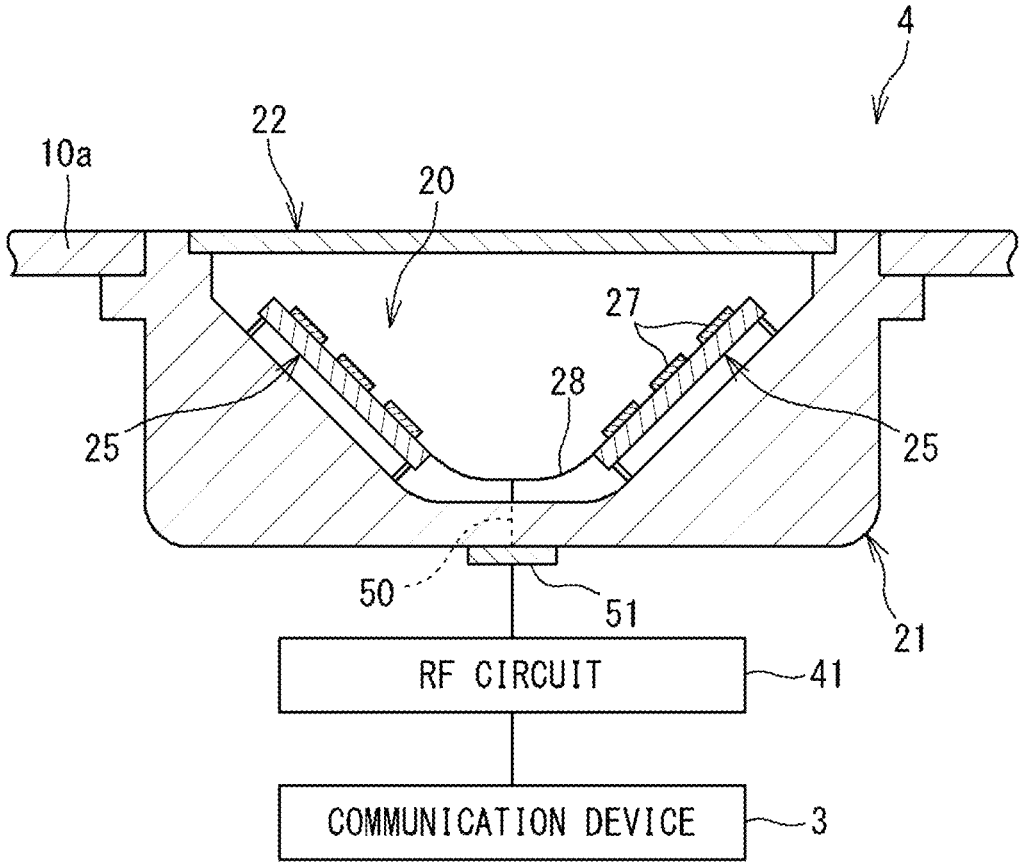
FIG. 7 is a sectional view of an antenna module according to another embodiment.

FIG. 7 is a sectional view of the antenna module 4 according to another embodiment.

In the antenna module 4 of the present embodiment, the RF circuit 41 is provided outside the housing 21, and a pair of antenna bases 25 are connected to each other via the bending portion 28.

From the bending portion 28, a line 50 connected to the power feed line 37 formed at the bending portion 28 extends. The line 50 is connected to a connector 51 which is provided outside the housing 21 and to which the RF circuit 41 is connected.

The pair of antenna bases 25, and the RF circuit 41, are connected via the line 50 and the connector 51 such that power can be fed therethrough.

Also in the present embodiment, one antenna base 25 having the radiation surface 25*a* inclined relative to the opening plane 23 and another antenna base 25 having the radiation surface 25*a* inclined in a direction different from the direction of the one antenna base 25, are provided. Thus, the orientation direction of radio waves transmitted/received through the radome 22 attached at the opening plane 23 can be ensured over a wide range.

[Others]

It is noted that the embodiments disclosed herein are merely illustrative in all aspects and should not be recognized as being restrictive.

In the above embodiments, the case where each antenna base 25 is configured as an array antenna and is capable of beamforming has been shown as an example. However, some or all of the antenna bases 25 may be configured as a planar antenna not having a beamforming function.

In the above embodiments, the case of providing four antenna bases 25 and the case of providing two antenna bases 25 have been shown as examples. However, three antenna bases 25 may be provided or five or more antenna bases 25 may be provided. In this case, the circuit substrate 26 is preferably formed in a polygonal shape in accordance with the number of the antenna bases 25. This is because the antenna bases 25 can be connected to the respective side ends of the circuit substrate 26.

In the above embodiments, the case where the bending portion 28 is formed by a bendable dielectric film has been shown as an example. However, instead of a dielectric film, the bending portion 28 may be formed by a hinge or the like which rotatably connects the circuit substrate 26 and the antenna base 25 and allows power feeding therethrough.

In the above embodiments, the case where the antenna module 4 is provided to the roof 10*a* of the vehicle 10 has been shown as an example. However, the antenna module 4 may be provided to the body (in particular, an upward surface) of the vehicle 10 other than the roof 10*a*, and for example, may be provided to a trunk, a hood, or the like.

The scope of the present invention is defined by the scope of the claims rather than the above description, and is intended to include meaning equivalent to the scope of the claims and all modifications within the scope.

REFERENCE SIGNS LIST

1 on-vehicle communication apparatus
2 base station
3 communication device
4 antenna module
10 vehicle
10*a* roof
10*a*1 end edge
10*b* opening
20 module body
21 housing
21*a* opening
21*b* bottom portion
21*b*1 inner surface
21*b*2 outer surface
21*c* inclined portion
21*d* end edge
22 radome
22*a* surface
23 opening plane
25 antenna base (first antenna, second antenna)
25*a* radiation surface (first radiation surface, second radiation surface)
25*a*1 uppermost end
26 circuit substrate
27 radiation element
28 bending portion
29 first dielectric layer
30 second dielectric layer
31 third dielectric layer
32 fourth dielectric layer
33 fifth dielectric layer
34 ground pattern
36 dielectric layer
37 power feed line
38 ground pattern
39 ground pattern
41 RF circuit
42 connector
43 bracket
50 line
51 connector

The invention claimed is:

1. An antenna module comprising:

a first antenna having a first radiation surface inclined relative to a placement plane at which a radome is provided;

a second antenna having a second radiation surface inclined in a direction different from the first antenna;

a circuit substrate including a radio frequency (RF) circuit;

a first bending portion having a band shape, the first bending portion connecting the first antenna to the circuit substrate to allow power to be fed between the first antenna and the circuit substrate; and a second bending portion having a band shape, the second bending portion connecting the second antenna to the circuit substrate to allow power to be fed between the second antenna and the circuit substrate, wherein the first bending portion connects an edge of a first side of the circuit substrate to an edge of the first antenna, and the second bending portion connects an edge of a second side of the circuit substrate to an edge of the second antenna.

2. The antenna module according to claim 1, wherein the first antenna and the second antenna are arranged such that a normal direction of the first radiation surface and a normal direction of the second radiation surface cross each other on a side where both radiation surfaces are present.

3. The antenna module according to claim 1, wherein the first antenna and the second antenna are each an array antenna capable of forming a beam, and the antenna module further comprising a control unit configured to control a direction of the beam within such a range that the beam is not blocked by a conductor located around the radome.

4. The antenna module according to claim 1, wherein the antenna module is for use in a vehicle.

5. A vehicle comprising the antenna module according to claim 1.

6. The vehicle according to claim 5, wherein the antenna module is attached to an opening provided in a body of the vehicle such that a surface of the radome is flush with a surface of the body.

7. The antenna module according to claim 1, wherein the first antenna and the second antenna are inclined such that the first radiation surface and the second radiation surface face toward a center side of the placement plane.

8. An antenna module comprising:

a first antenna having a first radiation surface inclined relative to a placement plane on which a radome is located;

a second antenna having a second radiation surface inclined in a direction different from the first antenna; and a housing having a box shape and a first face forming the placement plane, the housing accommodating the first antenna and the second antenna, wherein the housing includes:

retaining portions for retaining the first antenna and the second antenna with the first antenna and the second antenna being inclined, an opening at the first face; and a stepped portion that contacts with a peripheral edge of the radome and holding the peripheral edge, the stepped portion being at an end edge of the opening.

* * * * *